United States Patent [19]

Smith et al.

[11] 4,174,510

[45] Nov. 13, 1979

[54] RF TRANSFORMER

[75] Inventors: James L. Smith, Naperville; Harold W. Helenberg, Calumet City; Dennis J. Kilsdonk, Joliet, all of Ill.

[73] Assignee: The United States of America as represented by the United States Department of Energy, Washington, D.C.

[21] Appl. No.: 865,162

[22] Filed: Dec. 28, 1977

[51] Int. Cl.[2] ..... H01F 27/02; H01F 27/28

[52] U.S. Cl. ..... 336/62; 29/605; 336/70; 336/82; 336/96

[58] Field of Search ..... 336/62, 82, 96, 70, 336/69, 231, 90, 94; 29/605; 264/272

[56] References Cited

U.S. PATENT DOCUMENTS

| | | | |
|---|---|---|---|
| 1,936,309 | 11/1933 | Northrup | 336/62 |
| 2,445,169 | 7/1948 | Frey | 336/96 X |
| 2,453,731 | 11/1948 | Somes | 336/62 |
| 2,515,874 | 7/1950 | Hoyler et al. | 336/70 X |
| 2,591,339 | 4/1952 | Davis | 336/62 X |
| 2,663,827 | 12/1953 | Baker | 336/62 |
| 2,825,033 | 2/1958 | Rudd et al. | 336/82 X |
| 2,942,214 | 6/1960 | Fruengel | 336/82 X |
| 3,617,966 | 11/1971 | Trench et al. | 336/96 |
| 3,774,298 | 11/1973 | Eley | 336/96 X |

*Primary Examiner*—Thomas J. Kozma

*Attorney, Agent, or Firm*—Dean E. Carlson; Frank H. Jackson; Paul A. Gottlieb

[57] ABSTRACT

There is provided an improved RF transformer having a single-turn secondary of cylindrical shape and a coiled encapsulated primary contained within the secondary. The coil is tapered so that the narrowest separation between the primary and the secondary is at one end of the coil. The encapsulated primary is removable from the secondary so that a variety of different capacity primaries can be utilized with one secondary.

7 Claims, 6 Drawing Figures

RF TRANSFORMER

CONTRACTUAL ORIGIN OF THE INVENTION

The invention described herein was made in the course of, or under, a contract with the UNITED STATES DEPARTMENT OF ENERGY.

BACKGROUND OF THE INVENTION

In material tests utilizing RF resistance heating, an RF transformer is often required as a current step-up between the generating means and the load. With prior art practice, it has been possible to precisely match a load only by having available multiple transformers, though approximate matching has been possible with low-coupling-coefficient multiple-tapped transformers. To obtain a high current step-up ratio, a high coupling coefficient is needed between the secondary and primary. Prior art transformers have a relatively large uniform gap between the primary and secondary to prevent damage from electric arcs formed between the primary and secondary. This large spacing results in a low coupling coefficient. Further, the round tubing used for the primary in such RF transformers suffers from large resistance losses due to the proximity effect.

It is therefore an object of this invention to provide an improved RF transformer.

Another object of this invention is to provide an RF transformer with a high coupling coefficient.

SUMMARY OF THE INVENTION

An improved RF transformer is provided which includes a secondary in the form of an enclosed cylinder within which is contained a coil-type primary. The shape of the primary coil is a tapered cylinder so that the gap between the primary coil and the cylindrical secondary is wide at the end of the coil where there is the largest voltage difference between primary and secondary and narrow where there is the smallest voltage between primary and secondary. The primary is encapsulated and is made removable from the cylindrical secondary so that a plurality of different primaries can be utilized with each secondary, which greatly improves the flexibility of the transformer. The primary coil is of oval cross section so that resistance losses in the coil are reduced due to the greater current carrying area of the oval coil.

DETAILED DESCRIPTION OF THE INVENTION

Figure 1:
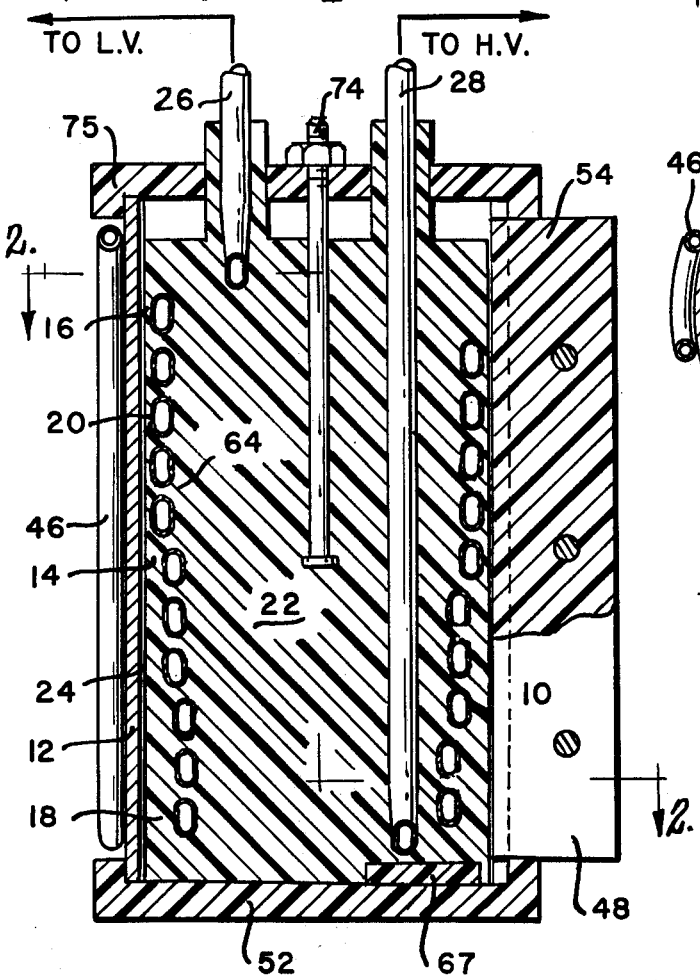
FIG. 1 and FIG. 2 are sections of an assembled transformer.
Figure 2:
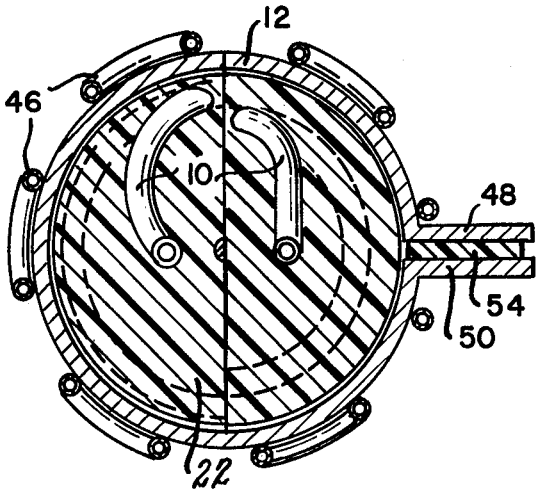

There is herein described an improved RF transformer and method for making an improved RF transformer. Referring to FIG. 1 and FIG. 2, there is shown an assembled RF transformer. The transformer includes a primary coil 10 contained within a secondary 12. In the embodiment shown, secondary 12 is in the form of a single-turn coil fabricated in a cylindrical can-like structure. The primary 10 is in the form of a multiple-turn coil of conductor. In the prior art RF transformers, primary coil 10 has a constant outside diameter over its entire length. Further, prior art transformers are assembled so that each transformer is in a fixed, sealed package usable only for one particular range of loads and output currents. For each new range a new transformer package has to be provided and installed. There is herein disclosed an improved RF transformer and method for making an improved RF transformer, with a high coupling coefficient and improved flexibility as to the range of output currents and loads which may be matched by the transformer.

The RF transformer shown in FIG. 1 and FIG. 2 has a primary coil 10 of tapered cross section so that the gap 14 between the primary 10 and the secondary 12 is narrowest at one end 16 of the transformer. The gap 14 gradually widens so that it is widest at the other end 18 of the transformer. A close average primary/secondary spacing or gap 14 results in a transformer with a high coupling coefficient. The tapered primary 10 allows a close average spacing with an adequate spacing 14 to prevent failure at the end 18 where the highest voltages occur. The conductor forming primary coil 10 has been wound so that it has a flattened or oval-like cross section with the flattened surface 20 facing the secondary 12 across gap 14. Since, due to the proximity effect, current in coil tubing flows in the area of the coil facing the secondary, a flattened area 20 increases the current carrying area of coil 10 and thereby decreases resistance losses in the primary.

To insure the symmetrical positioning of primary 10 within secondary 12 and to promote the replaceability of primary 10, primary 10 is encapsulated in a hardened insulative material 22 generally conforming to the dimensions of secondary 12. The gap 24 between the encapsulated primary and the secondary is filled with an oil insulator to prevent corona and thereby breakdown of the transformer. Terminals 26 and 28 provide connections to the primary. The assembled transformer can be adapted to different desired outputs by replacing the encapsulated coil 10 with a coil having fewer or more turns as desired.

Figure 3:
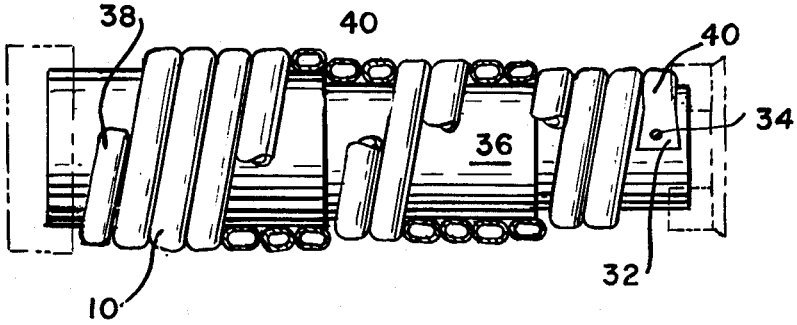
FIG. 3 shows the means for wrapping the primary coil of the transformer.

Referring to FIG. 3, FIG. 4, FIG. 5 and FIG. 6 there is shown a method of making the transformer described above. In FIG. 3 there is shown a method of forming the primary coil 10. The coil is formed of a metal tubing such as copper tubing. Tubing of ½ inch diameter and 1/32 inch wall thickness has been found to be satisfactory. One end 32 of the coil is flattened, about ¾ inch in length, and a body mounting hole 34 is drilled in the flattened end 32. Tubing 10 is bolted to a mandrel 36 through hole 34. Mandrel 36 is a tapered pipe about which coil 10 may be wrapped. The dimensions of the mandrel 36 should be selected to produce the final desired dimensions of the coil. The mandrel could be formed of a single machined pipe or several pipes coupled together. A satisfactory pipe has been made out of Lucite and may be mounted on a lathe to assist in the wrapping of the coil. Further, the mandrel 36 may be wrapped with a material such as Mylar until the desired diameter is obtained and to obtain a smooth taper is such is desired.

In prior art practice where constant outside diameter coils were desired, a perfectly uniform diameter mandrel was utilized in which a threaded or grooved outer surface was provided to prevent slippage of the pipe as it was wound and also to prevent flattening of the coil tubing as the tubing was wrapped to form the coil. The method of wrapping herein disclosed differs in that the mandrel is not of of constant diameter and is not grooved. As the coil is wrapped around the mandrel, the tubing will naturally flatten out. A slight tension is applied to the tubing during wrapping to insure that the tubing wraps tightly on the mandrel 36. The flattened cross section is desired, since it has the advantage of providing a greater current carrying area, as has been previously described. The tubing is maintained tightly on the mandrel as it is wound to form the coil or otherwise the coil will spring back and not maintain the proper dimensions. The coil may then be removed from the mandrel and cut to the desired length. Of course, the number of turns of a coil has been predetermined. Tubing leads may be then coupled to both ends 38 and 40 of the resulting tubing, as shown in FIG. 1, to provide the output leads for coupling to the coil.

The secondary can-type assembly is basically the same as has been used in the prior art. We show here a one-turn can-type assembly, although multiple turns are certainly possible. The one-turn secondary, as shown in FIG. 1 and FIG. 2 includes a solid copper cylinder to which cooling tubes 46 are coupled. The output from the secondary is by way of the plates 48 and 50. The secondary is normally formed of copper sheet and the inside surfaces of the formed secondary are polished.

Figure 4:
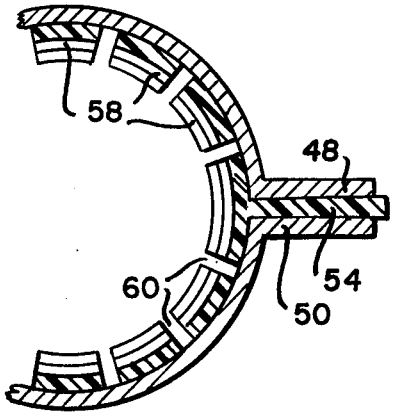
FIG. 4 shows the secondary prepared to be used in the first stage of encapsulation of the primary coil.
Figure 5:
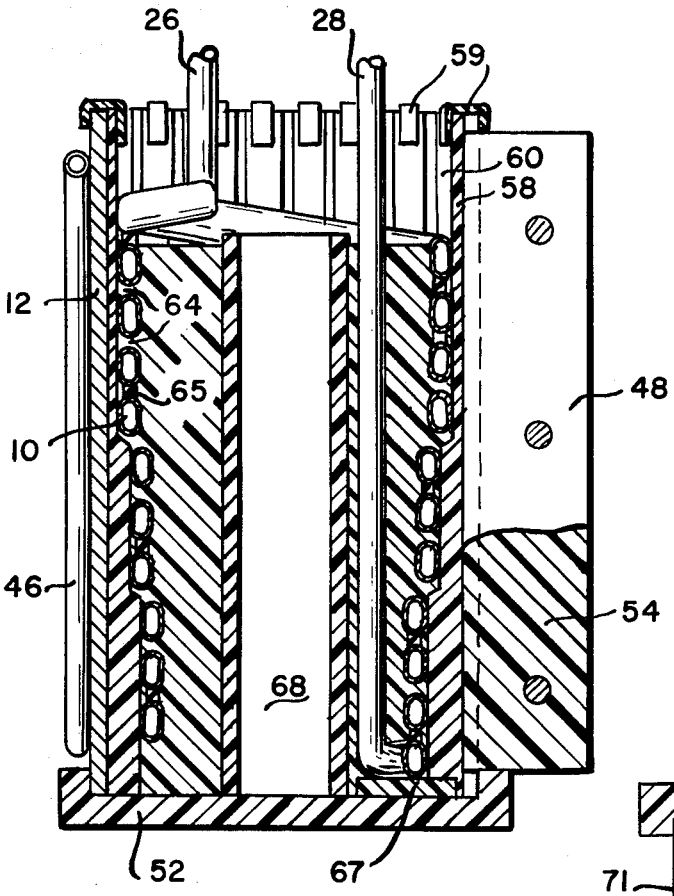
FIG. 5 shows the first stage of encapsulation.

To facilitate the encapsulation and the installation of the coil in the secondary, a bottom cover 52 is sealed to the bottom of the secondary 12. The secondary with bottom cover 52 installed is to be used as a mold for encapsulation of the primary as shown in FIG. 4 and FIG. 5. A silicone rubber insulative spacer 54 is placed between the plates 48 and 50 which are then clamped together to form a sealed can in which the coil 10 may be encapsulated. A plurality of spacers 58 are positioned about the can with a separation 60 between each spacer, as shown in FIG. 4. The spacers 58 are more particularly shown in the cross section of FIG. 5 and they are tapered to generally conform to the shape of the coil. FIG. 5 shows spacers 58 with discrete steps in thickness but spacers with a continuous taper could be used if desired. The spacers are taped in place with a tape 59. The material for the spacers and the tape is chosen so as to allow release of the spacers from the encapsulated coil. Teflon tape and Teflon spacers are satisfactory. These are elements which, during the curing process of the encapsulation material, will remain integral to allow for removal of the encapsulated coil.

Maintaining a proper spacing 64, as shown in FIG. 1, between each turn of the primary coil in the final encapsulated coil is essential. Small chips 65 of hardened encapsulation material are inserted in gaps 64 between each turn of the coil to insure the proper spacing between each turn of the coil. During encapsulation they will unite with the rest of the encapsulation material during curing and the spacing will be maintained in the encapsulated coil.

The encapsulation process of the coil is preferably done in a two-step procedure with an epoxy. In the first step, the coil is inserted into the secondary coil can as shown in FIG. 5. The bottom cover 52 is installed in the bottom of the can. A fiber glass spacer 67 is placed in the bottom of the assembly and is of a height such that the coil 10 is at the desired position in the secondary. A PVC tubular spacer 68 is installed in the center of the assembly to prevent the epoxy encapsulation material from cracking. Using standard epoxy encapsulating techniques, the coil 10 is placed in the can on top of the spacer 67 and separated from can 12 by spacers 58. The area outside of spacers 58, 67 and 68 is then filled with the flowing epoxy and cured in the normal manner.

In the next step, the solidified encapsulated coil is removed from the secondary coil and spacers 58 are removed from the encapsulated coil. This can be facilitated by separating clamped plates 50 and 48 to allow for easy removal of the primary coil. In the second step of encapsulation, the areas not filled by the first step, including areas where the spacers had been, will be filled. Note that, because of the separation 60 between the spacers 58, the shape of the encapsulated coil will include projections 61 which filled areas 60 between each spacer and voids 63 where each spacer 58 was. Therefore, when the encapsulated coil is replaced into the can, it will be a relatively snug fit.

Figure 6:
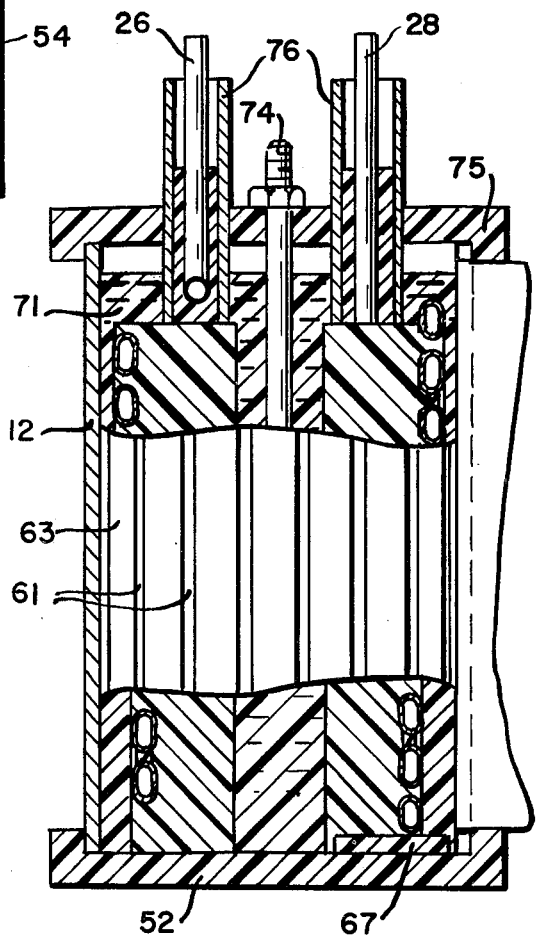
FIG. 6 shows the second stage of encapsulation.

In the second step of encapsulation, the spacer 67 is again installed in the bottom of the can to help insure proper flow of encapsulating material and centering of primary 10 in the secondary 12. As shown in FIG. 6, the coil is then inserted again into the can resting on the spacer 67. In this instance, however, the voids as shown in FIG. 6 will be filled by the injection of liquid epoxy 71 through the area vacated by the center spacer 68. A center mounting rod 74 may be inserted into this central vacated area, held in line by top cover 75, to facilitate the final transformer assembly. Cylinders 76 are placed about terminals 77 and 78 to allow for their individual encapsulation. The resulting encapsulated coil will be cylindrical in appearance with the two terminals and the center mounting rod extending from the cylindrical assembly. The primary coil leads are preferably potted themselves in a separate arrangement so that they are adequately electrically insulated during actual operation.

The final encapsulated coil will have shrunk during the curing process from the exact inner diameter of the secondary can. This is advantageous since the encapsulated coil will then be able to be slid into and out of the secondary. In an actual assembly, it is, of course, necessary that this slight slip fitting be eliminated to prevent a corona discharge. Therefore an insulator needs to be placed in the gap. Transformer oil is, of course, a choice to fill the gap. The assembly of the encapsulated coil in the can is placed in a vacuum system to remove any air present and the oil is filled in the space under vacuum. The cover 75 which maintains the proper alignment of the encapsulated coil is finally installed on the assembly.

By using the oval shaped tubing in the primary coil winding, a greater surface area for carrying the high frequency current versus a circular tubing is obtained. This allows less power loss in the primary coil winding and more power available for transfer to the secondary. By tapering the primary coil, higher voltages may be applied to the primary coil for a given average primary to secondary spacing. High coupling coefficients are achievable because of minimum average primary to secondary spacing obtained by the tapering and by the reliable symmetrical encapsulation of the coil. Further, due to the flexibility of being able to replace the encapsulated coils for a particular secondary, cost savings and convenience can be obtained.

The embodiments of the invention in which an exclusive property or privilege is claimed are defined as follows:

1. An RF transformer, comprising: a can-type secondary, a tapered primary coil encapsulated in epoxy contained within and slip-fitted into said secondary, a constant separation between said encapsulant and said secondary, a gap between said primary and said secondary at one end of said coil is smaller than at the other end and said gap generally tapers between said two ends, and an insulative fluid filling the separation between said encapsulated coil and said can-type secondary.

2. The transformer of claim 1 wherein the cross section of the conductor forming said coil is flattened to provide greater surface area for current conduction.

3. The transformer of claim 2 wherein said one end is coupled to a higher voltage than the said other end of said coil.

4. A method of making an RF transformer having a can-type secondary comprising:

a. forming a tapered, cylindrical primary coil of metal tubing, b. coupling tube leads to each end of said coil, c. encapsulating said coil in an insulative epoxy to form a cylindrical encapsulated primary coil assembly capable of being inserted into a can-type secondary and having a diameter slightly smaller than said can-type secondary, and inserting said encapsulated coil into said can-type secondary, and filling the separation therebetween with an insulative fluid.

5. The method of claim 4 wherein said coil is formed so that the cross section of the conductor forming said coil is flattened.

6. The method of claim 5 wherein during said encapsulation of said coil, hardened epoxy spacers are placed between each turn of said coil to ensure proper spacing between each turn in said encapsulated coil.

7. The method of claim 6 wherein said encapsulation includes a. placing separated spacers about said can-type secondary, a cylinder in the center of said can-type secondary, and a pedestal spacer on the bottom of said can-type secondary, b. inserting said coil into said can-type secondary, said spacers being of such dimension that said coil is properly positioned within said can-type secondary, c. inserting flowing epoxy into the areas within said can-type secondary exclusive of said spacers and curing said epoxy to form a partially encapsulated coil, d. removing said partially encapsulated coil and said spacers from said can-type secondary, and e. reinserting said partially encapsulated coil into said can-type secondary and filling the voids previously occupied by said spacers with said epoxy.

* * * * *